United States Patent [19]

Sakashita et al.

[11] Patent Number: 4,952,476

[45] Date of Patent: Aug. 28, 1990

[54] ELECTROPHOTOGRAPHIC MAGNETIC TONER CONTAINING POLYALKYLENE AND VINYL POLYMER

[75] Inventors: Kiichiro Sakashita, Inagi; Toshiaki Nakahara, Tokyo; Hirohide Tanikawa, Yokohama; Satoshi Yoshida, Kawasaki, all of Japan

[73] Assignee: Canon Kabushiki Kaisha, Tokyo, Japan

[21] Appl. No.: 313,456

[22] Filed: Feb. 22, 1989

[30] Foreign Application Priority Data

Feb. 29, 1988 [JP] Japan ..... 63-044352

[51] Int. Cl.[5] ..... G03G 9/14; G03G 11/00

[52] U.S. Cl. ..... 430/106.6; 430/903

[58] Field of Search ..... 430/106.6, 109, 903

[56] References Cited

U.S. PATENT DOCUMENTS 4,137,188 1/1979 Uetake ..... 430/903

*Primary Examiner*—J. David Welsh

*Attorney, Agent, or Firm*—Fitzpatrick, Cella, Harper & Scinto

[57] ABSTRACT

A magnetic toner comprising a binder resin, magnetic powder and 0.1–10 wt. % (based on resin component) of a low-molecular weight polyalkylene, the binder resin comprising a vinyl-type polymer having 5 to 80 wt. % of a tetrahydrofuran (THF)-insoluble; the magnetic toner having a melt index of 0.2 to 12 g/10 min. (125° C., 10 kg load); the residual magnetization $\sigma_r$ and the volume-average particle size d of the magnetic toner satisfying the following formula:

$$3.7-0.11d \leqq \sigma_r \leqq 6.5-0.23d,$$

wherein $\sigma_r$ represents a residual magnetization (emu/g) under an external magnetic field of 1 KÖe and d represents a volume-average particle size of 3 to 16 microns.

20 Claims, 2 Drawing Sheets

ELECTROPHOTOGRAPHIC MAGNETIC TONER CONTAINING POLYALKYLENE AND VINYL POLYMER

FIELD OF THE INVENTION AND RELATED ART

The present invention relates to a magnetic toner for use in image forming methods, such as electrophotography, electrostatic recording, and magnetic recording.

Hitherto, a large number of electrophotographic processes have been known, as disclosed in U.S. Pat. Nos. 2,297,691; 3,666,363 (corresponding to Japanese Patent Publication (KOKOKU) No. 23910/1967); 4,071,361 (corresponding to Japanese Patent Publication No. 24748/1968) and others. In these processes, an electric latent image is formed on a photosensitive member comprising a photoconductive material by various means, then the latent image is developed and visualized with a toner, and the resultant toner image is, after being transferred onto a transfer material such as paper as desired, fixed by heating, pressing, heating and pressing, etc., thereby to obtain a copy.

Various developing methods for visualizing electrostatic latent images have also been known. For example, there have been known the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; in addition, the fur brush developing method; and the liquid developing method. Among these developing methods, the methods using a developer composed mainly of a toner and a carrier such as the magnetic brush method, the cascade process and the liquid developing method have been widely used commercially. While these methods provide good images relatively stably, they involve common problems accompanying the use of two-component developers, such as deterioration of carriers and change in mixing ratio of the toner and carrier.

In order to obviate such problems, various developing methods using a one-component developer consisting only of a toner, have been proposed. Among these, there are many excellent developing methods using developers comprising magnetic toner particles.

U.S. Pat. No. 3,909,258 has proposed a developing method using an electroconductive magnetic toner, wherein an electroconductive magnetic toner is carried on a cylindrical electroconductive sleeve provided with a magnet inside thereof and is caused to contact an electrostatic image to effect development. In this method, as the development zone, an electroconductive path is formed with toner particles between the recording member surface and the sleeve surface and the toner particles are attached to image portions due to a Coulomb's force exerted from the image portions to effect development. This method using an electroconductive magnetic toner is an excellent method which has obviated the problems involved in the two-component developing methods. However, as the toner is electroconductive, there is involved a problem, such that it is difficult to transfer the developed image electrostatically from the recording member to a final support member such as plain paper.

As a developing method using a magnetic toner with a high resistivity which can be electrostatically transferred, a developing method using a dielectric polarization of toner particles is known. Such a method, however, involves essential problems that the developing speed is slow and a sufficient density of developed image cannot be obtained.

As another method using a high resistivity magnetic toner, there are known methods wherein toner particles are triboelectrically charged through friction between toner particles or friction between a friction member such as a sleeve and toner particles, and then caused to contact an electrostatic image-bearing member to effect development. However, these methods involve problems that the triboelectric charge is liable to be insufficient because the friction between the toner particles and the friction member, and the charged toner particles are liable to agglomerate on the sleeve because of an enhanced Coulomb's force.

A developing method having eliminated the above described problems has been proposed in U.S. Pat. No. 4,395,476 (corresponding to Japanese Laid-Open Patent Application (KOKAI) No. 18656/1980). In this method, a magnetic toner is applied in a very small thickness on a sleeve, triboelectrically charged and is brought to an extreme vicinity to an electrostatic image to effect development. More specifically, in this method, an excellent image is obtained through such factors that a sufficient triboelectric charge can be obtained because a magnetic toner is applied onto a sleeve in a very small thickness to increase the opportunity of contact between the sleeve and the toner, the toner is carried by a magnetic force, and the magnet and the toner are relatively moved to disintegrate the agglomerate of the toner and cause sufficient friction between the toner and the sleeve, and the toner layer is caused to face an electrostatic image under a magnetic field and without contact to effect development.

Recently, as image forming apparatus such as electrophotographic copying machines have widely been used, their uses have also extended in various ways, and higher image quality has been demanded. Accordingly, some problems have been desired to be solved while taking advantage of the conventional magnetic toner. For example, when original images such as general documents and books are copied, it is demanded that even minute letters are reproduced extremely finely and faithfully without thickening or deformation, interruption or scattering.

With respect to a printer as a computer output device, there is demanded a high-reliability such that it stably provides clear images even in continuous successive use. Further, with respect to the field of precise graphic copying, a high density, thin-line reproducibility (or reproducibility in thin lines) and gradational characteristic adapted to large-area copying are demanded. However, in the prior art, when the latent image formed on a photosensitive member of an image forming apparatus comprises thin-line images having a width of 100 microns or below, the thin-line reproducibility is generally poor and the clarity of line images is still insufficient.

Particularly, in recent image forming apparatus such as electrophotographic printers using digital image signals, the resultant latent picture is formed by a gathering of dots with a constant potential, and the solid, half-tone and highlight portions of the picture can be expressed by varying densities of dots. However, in a state where the dots are not faithfully covered with toner particles and the toner particles protrude from the dots, there arises a problem that a gradational characteristic of a toner image corresponding to the dot density ratio of the black portion to the white portion in the digital latent image cannot be obtained. Further, when the resolution is intended to be enhanced by decreasing the dot size so as to enhance the image quality, the reproducibility becomes poorer with respect to the latent image comprising minute dots, whereby there tends to occur an image without sharpness having a low resolution and a poor gradational characteristic.

In order to solve the above-mentioned problems, there have been some proposals with respect to magnetic toners.

For example, U.S. Pat. No. 4,299,900 discloses a jumping developing method using a developer containing 10–50 wt. % of magnetic toner particles having a particle size of 20–35 microns. In this method, a suitable toner particle size is investigated in order to triboelectrically charge the magnetic toner, to apply the toner onto a sleeve to form a uniform thin toner layer, and to enhance the environmental stability of the image density and the developer.

Japanese Laid-Open Patent Application No. 21135/1981 disclose a developing method wherein the number-average molecular weight, residual magnetic moment and saturation magnetic moment of a magnetic toner are defined, and the toner is transferred onto a recording member under the action of a signal pulse supplied from a special electrode disposed opposite to the recording member.

However, in consideration of the above-mentioned higher demand for thin-line reproducibility and resolution, the magnetic toner of U.S. Pat. No. 4,299,900 is not sufficient, and therefore further improvement is desired.

Because the above-mentioned magnetic toner of Japanese Laid-Open Patent Application No. 21135/1981 is transferred to a recording member as tower-like toner agglomerates (i.e., those in a state wherein respective ears of toner particles are not linear form separately disposed on a toner-carrying member such as sleeve but are entangled to form toner (or spire)-like ears), it is difficult to obtain minute resolution and reproducibility. Further, this toner has a number-average particle size of 2–10 microns and a small residual magnetic moment of 0.1–2 emu/g, it cannot solve the above-mentioned problem when used in an ordinary developing system.

Japanese Laid-Open Patent Application No. 90640/1982 (corresponding to European Laid-Open patent Application No. 53491) defines the shape and magnetic property of a magnetic material for toner. When such non-pulverizable large magnetite agglomerates of 1–10 microns is used in a toner, dispersion failure of the magnetite is liable to occur in the toner particles thereby to cause fog and image quality deterioration in use.

SUMMARY OF THE INVENTION

An object of the present invention is to provide a magnetic toner which has solved the above-mentioned problems.

Another object of the present invention is to provide a magnetic toner which has an excellent thin-line reproducibility and gradational characteristic and is capable of providing a high image density.

A further object of the present invention is to provide a magnetic toner which shows little change in performances when used in a long period.

A further object of the present invention is to provide a magnetic toner which shows little change in performances even when environmental conditions change.

A further object of the present invention is to provide an excellent dry insulating magnetic toner which does not impair image quality in transfer and fixing steps.

A further object of the present invention is to provide a magnetic toner which is capable of providing a high image density by using a small consumption thereof.

A still further object of the present invention is to provide a magnetic toner which is capable of forming a toner image excellent in resolution, gradational characteristic, and thin-line reproducibility even when used in an image forming apparatus using a digital image signal.

According to the present invention there is provided a magnetic toner comprising a binder resin, magnetic powder and 0.1–10 wt. % (based on resin component) of a low-molecular weight polyalkylene, the binder resin comprising a vinyl-type polymer having 5 to 80 wt. % of a tetrahydrofuran (THF)-insoluble; the magnetic toner having a melt index of 0.2 to 12 g/10 min. (125° C., 10 kg load); the residual magnetization $\sigma_r$ and the volume-average particle size d of the magnetic toner satisfying the following formula:

$$3.7-0.11d \leqq \sigma_r \leqq 6.5-0.23d,$$

wherein $\sigma_r$ represents a residual magnetization (emu/g) under an external magnetic field of 1 KÖe and d represents a volume-average particle size of 3 to 16 microns.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
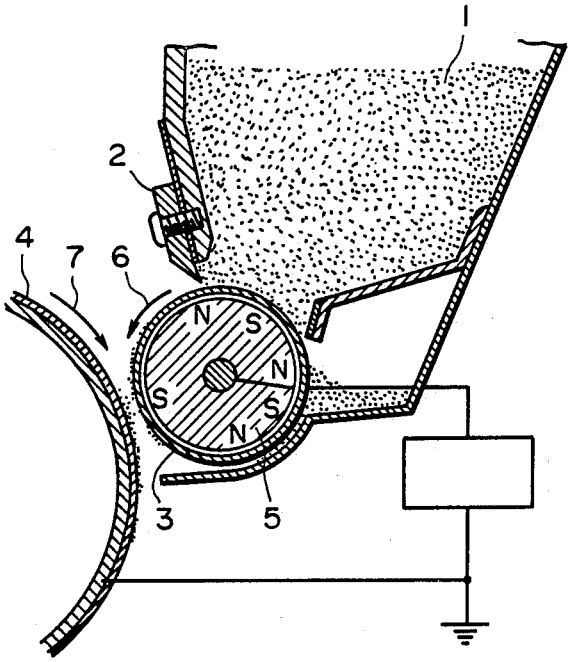
FIG. 1 is a schematic sectional view showing an embodiment of the developing device to which the magnetic toner according to the present invention is applicable.

As a result of study based on the above-mentioned background, we have found that deficiency in image density, low resolution, poor thin-line reproducibility of a magnetic toner, and blotch and irregularity or unevenness in a layer of the magnetic toner formed on a toner-carrying member such as a developing sleeve are based on whether magnetic toner particles disposed on the sleeve can form described linear ears, or on the length or shape of the ears, and have relation to the electrostatic and magnetic properties of the toner. Particularly, we have found that a specific relationship between the particle size and residual magnetization of a toner provides good results, and a desirable state of magnetic particle presence in the toner particles is provided by a specific binder resin. Based on such knowledge, we have reached the present invention.

The magnetic toner according to the present invention having the above-mentioned features can faithfully reproduce thin lines in a latent image formed on a photosensitive member, and is excellent in reproduction of dot latent images such as halftone dot and digital images, whereby it provides images excellent in gradation and resolution characteristics.

The reason for the above-mentioned effects of the magnetic toner of the present invention is not necessarily clear but may assumably be considered as follows.

In order to investigate the above-mentioned problems in the prior art, we have analyzed the relationship between a decrease in image density or disturbance in image quality, and the above-mentioned blotched irregular coating on a developing sleeve. The "blotched irregular coating" used herein refers to a phenomenon such that coating irregularities of toner particles in the form of spots or ripples occur on a developing sleeve, and white dropping or dropout in the blotch shape occurs in a solid black image, or an image in the blotch shape appears as such in a solid white image.

As a result of observation of such blotched irregular coating, it has been found that particles are attached to the sleeve surface due to various causes, and therefore triboelectrification with the sleeve becomes insufficient, whereby toner particles provided with insufficient charges form disturbed and bulky ears on the above-mentioned blocked irregular coating. Because these attachment particles ordinarily comprise charged toner particles attached to the sleeve under the action of electrostatic attraction, such phenomenon is more liable to occur when a larger amount of charges are imparted to the toner particles in order to enhance the image density. Particularly, such phenomenon is more liable to occur in continuous use under extremely low temperature—low humidity conditions for a long period, as compared with in ordinary successive use.

These attachment particles affect coating uniformity of the toner and susceptibiity thereof to development. The blotched irregular coating is an extreme case, and it may be considered that a decrease in image quality and a decrease in image density are due to the same cause, while the appearance form thereof is somewhat different. Disturbed ears or too long ears cannot faithfully develop a latent image, and there occur the protrusion of these ears from the latent image and toner scattering. Further, such ears cannot develop the latent image uniformly or densely, and provides an image having a weak covering power (i.e., hiding power of the toner per unit area) and a low image density.

Based on the above-mentioned results, we have found it effective to optimumly control the force exerted on a magnetic toner by a magnetic field, in order to prevent the magnetic toner particles from adhering, accumulating and agglomerating on the sleeve surface due to the mirror image force based on the charges of the toner particles, and to form linear ears suitable for development.

Now, FIG. 1 shows an embodiment of the developing device to which the magnetic toner of the present invention is applicable.

Referring to FIG. 1, a one-component-type developer 1 is applied onto a cylindrical sleeve 3 of stainless steel in a thin layer form through the medium of a magnetic blade 2, and conveyed from the gap or clearance between the sleeve 3 and the blade 2. The sleeve 2 contains a fixed magnet 5 as a magnetic field-generating means in the inside thereof. In a developing zone where the sleeve 3 is disposed opposite to a photosensitive drum 4 comprising, e.g., an organic photoconductor layer and carrying thereon a negatively charged latent image, the fixed magnet 5 exerts a magnetic field in the neighborhood of the sleeve surface. A bias voltage obtained by superposing an AC bias on a DC bias is applied between the photosensitive drum 4 rotating in the direction of an arrow 7, and the sleeve 3.

In such arrangement, when the magnetic toner particles pass through the gap between the sleeve 3 and the blade 2, they are to form ears under a maximum magnetic field externally applied thereto. However, in consideration of the above-mentioned investigation of ours, it is important that the toner particles retain the ears thereof under magnetic force exerted by the magnetic field, before and after the above-mentioned passage, particularly after the passage between the sleeve 3 and the magnetic blade 2, by resisting the power again exerted thereon which tends to cause the toner particles to adhere, accumulate or agglomerate on the sleeve 3, even when the magnetic regulation force becomes weaker.

In addition, in consideration of the relationship between the length of the ear and the particle size of the toner, we have found that the following specific relationship is effective in solving the problems:

$$3.7-0.11d \leqq \sigma_r \leqq 6.5-0.23d,$$

wherein $\sigma_r$ denotes the residual magnetization of the toner and d denotes the average particle size of the toner. Further, in order to fully achieve such effect, we have found it effective that the binder resin for constituting the toner comprises a vinyl-type polymer having 5–80 wt. % of a tetrahydrofuran (THF)-insoluble and the magnetic toner has a melt index (MI) of 0.2–12 g/10 min., and the magnetic toner may more preferably contain low-molecular weight polyalkylene.

Hereinbelow, there is specifically described the magnetic toner according to the present invention.

Figure 3:
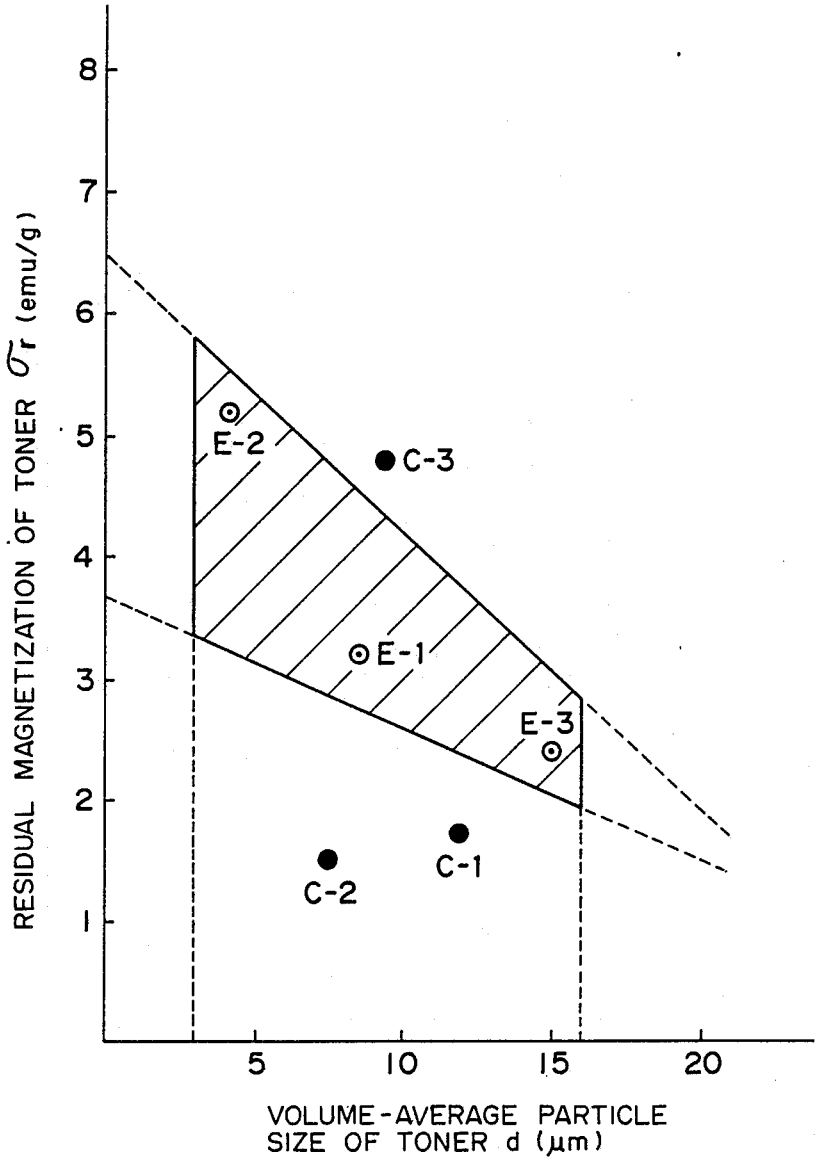
FIG. 3 is a graph showing relationships between the volume-average particle size and residual magnetization with respect to the magnetic toners obtained in Examples and Comparative Examples described hereinafter.

In the present invention, it is necessary that the residual magnetization $\sigma_r$ and volume-average particle size d of the magnetic toner satisfy the following relationship:

$$3.7-0.11d \leqq \sigma_r \leqq 6.5-0.23d,$$

wherein $\sigma_r$ denotes a residual magnetization (emu/g) under an external magnetic field of 1 KÖe, and d denotes a volume-average particle size in the range of 3 to 16 (microns). The hatched portion in FIG. 3 shows the thus defined region.

If $\sigma_r > 6.5-0.23d$, $\sigma_r$ of the toner particles is too large in view of the particle size thereof. In such case, the force to erect the toner particles on a developing sleeve is strong and blotch is less liable to occur. However, the ears of the toner particles become too long and exceed 100 microns (e.g., 150 microns) to be longer than the width of a thin-line latent image to be developed. As a result, the toner particles protrude from the latent image and are scattered to deteriorate the image quality. Further, the ear of the toner particles becomes long and the thickness of the toner coating becomes large, and each particle is difficult to be uniformly charged, thereby to cause an image density decrease and fog. In successive copying, toner particles having low chargeability are accumulated in an developing device to cause a long-term decrease in image density and image quality.

If $\sigma_r < 3.7-0.11d$, the $\sigma_r$ of the toner particle is too small and there occurs blotched irregular coating on a sleeve, a decrease in image density and image quality due to disturbed tower-like ears of toner particles. Particularly, when the volume-average particle size of a toner becomes small, the surface area of the toner increases, triboelectric chargeability to the sleeve becomes large, and the electrostatic adhesion force to the sleeve becomes large, whereby the above-mentioned problems are more liable to occur.

However, in a case where the volume-average particle size and residual magnetization of a magnetic toner are defined in the above-mentioned manner, we have found that the above objects of the present invention are not fully solved in some cases. As a result of investigation on this point, we have found that such problem relates to the state of presence of magnetic material in a binder resin constituting the magnetic toner.

In the present invention, the above binder resin comprises a vinyl-type polymer having a tetrahydrofuran-insoluble of 5–80 wt. %, preferably 10–60 wt. %. When the tetrahydrofuran-insoluble is 5–80 wt. %, the magnetic material is extremely uniformly dispersed in the binder resin in a melt-kneading step.

If the toner contains a slight amount of unsuitable toner particles, they are liable to cause blotched irregular coating. In such viewpoint, the above-mentioned uniform dispersion of the magnetic material is very effective in uniformizing the magnetic property of the respective toner particles.

In the present invention, better results may be obtained in a case where the melt viscosity of the kneaded material is enhanced by regulating the amount of the tetrahydrofuran-insoluble contained in the binder resin, as compared with the case where the melt viscosity is enhanced by decreasing the kneading temperature to increase shear. This may be attributable to that the tetrahydrofuran-insoluble contained in the binder resin suppresses the coating of a magnetic material or charge controller with a resin component, and functions so as to enhance the chargeability and stability on the resultant toner particles, thereby to enhance the characteristic of the magnetic toner of the present invention.

If the tetrahydrofuran-insoluble content is smaller than 5 wt. %, the above-mentioned effect becomes a little. On the other hand, if the tetrahydrofuran-insoluble content is larger than 80 wt. %, the fixability decreases, and crushing of a kneaded product becomes difficult thereby to lower the productivity. Further, when an ordinary kneading machine is used, fusion failure or deficiency in shear force occurs, whereby the dispersion is not sufficiently conducted.

The binder resin used in the magnetic toner of the present invention may comprise a vinyl-type polymer or copolymer, preferably a styrene-type copolymer. Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; conjugate diene monomers or their derivatives such as butadiene, isoprene, and chloroprene; vinyl ketones, such as vinyl methyl ketone, and vinyl hexyl ketone; vinyl ethers, such as vinyl methyl ether, vinyl ethyl ether, and vinyl isobutyl ether.

In a case where a crosslinking agent is required, a compound having two or more polymerizable double bonds may principally be used as the crosslinking agent. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1, 3-butanediol diacrylate; divinyl compounds such as divinyl ether, divinyl sulfide and divinyl sulfone; and compounds having three or more vinyl groups. These compounds may be used singly or in mixture. The crosslinking agent may preferably be used in an amount of 0.01–5 wt. % based on the binder resin.

In the present invention, preferred examples of the vinyl-type polymer may include crosslinked styrene-acrylic acid ester-type copolymers and crosslinked styrene-methacrylic acid type copolymers.

The above-mentioned vinyl polymers can be used as a mixture of two or more species, as desired. Further, these vinyl polymers can be used as a mixture with another binder resin for a toner.

The binder resin used in the present invention may preferably be one capable of providing a molecular weight distribution such that there is at least one peak in the molecular weight range of 2,000–10,000. It is preferred that the component having a molecular weight in the range of 2,000–10,000 is contained in the binder resin in an amount of 3–60 wt. % (more preferably 10–50 wt. %) based on THF-soluble of the binder resin. In such case, there may be provided a toner composition which is excellent in fixability and pulverizability in toner production.

The melt index of the magnetic toner of the present invention relates to the tetrahydrofuran-insoluble content in the binder resin therefor, and may preferably be 0.2–12 g/10 min. (125° C., load: 10 kg), more preferably 0.5–8 g/10 min.

If the melt index is below 0.2 g/10 min., the magnetic toner has poor fixability and there is liable to occur a phenomenon such that toner particles having poor fixability are attached to a fixing roller due to charging, or unfixed toner particles are scattered due to pressure from the fixing roller, whereby the image quality is decreased. If the melt index is larger than 12 g/10 min., image deformation due to fixing is considerable, and the resolution and thin-line reproducibility undesirably deteriorate.

Further, the magnetic toner of the present invention may preferably contain a polyalkylene having a weight-average molecular weight of 2,000–30,000 in an amount of 0.1–10 wt. %, more preferably 0.5–8 wt. % based on the weight of the resin component.

When the polyalkylene having a weight-average molecular weight of 2,000–30,000 is added to the toner, there is obtained an effect such that the fixed toner image is more easily released from a fixing roller at the time of fixing to prevent deterioration in image quality. In addition, there is also obtained much effect of reducing coagulation between toner particles as a lubricant or lubricating agent. More specifically, the polyalkylene uniformizes the fluidity of toner particles in a developing device in a copying process, and stabilizes the charging and prevents the occurrence of agglomerate toner particles, thereby to enhance the image quality.

Incidentally, in a process (pulverization process) for producing the toner, a coarsely crushed product supplied from a nozzle may be caused to collide with an impact plate disposed opposite to the nozzle together with high-pressure air, thereby to effect micropulverization. We have found that in the above process, the polyalkylene prevents attachment of the particles to the impact plate and re-fusion between pulverized particles thereby to facilitate the production of a toner having a desired performance and shape. Particularly with respect to the toner shape, the polyalkylene provides a different state of magnetic powder present on the toner particle surfaces and have much effect.

The above-mentioned weight-average molecular weight is not in the range of 2,000–30,000, it is difficult to obtain the above effects. If the polyalkylene content is below 0.1 wt. %, the effect is a little. If the polyalkylene content is larger than 10 wt. %, the mixing thereof with a binder resin becomes difficult to easily produce free polyalkylene, whereby an image defect such as fog is liable to occur.

Specific examples of the polyalkylene used in the magnetic toner of the present invention may include: homopolymers of olefin monomer such as ethylene, propylene, butene-1, hexene, and 4-methylpentene-1; copolymers such as ethylene-propylene copolymer, ethylene-butene-1 copolymer, ethylene-hexene copolymer, propylene-ethylene copolymer, propylene-butene copolymer, and propylene-hexene copolymer; and heat-treated products of these polymers. Particularly, there may preferably be used polyethylene, polypropylene, copolymers comprising propylene and ethylene, butene, etc., and heat-treated products of these polymers (i.e., products wherein the molecular chains have been cloven by heat-treating).

The tetrahydrofuran (THF)-insoluble in the present invention represents a weight ratio of the polymer components (substantially crosslinked polymer) which have become insoluble in THF solvent in the resin composition in the toner.

The magnetic toner according to the present invention contains a magnetic material which also functions as a colorant in some cases.

The magnetic material to be contained in the magnetic toner of the present invention may include iron oxides such as magnetite, $\gamma$-ion oxide, ferrite or excess iron component-type ferrite; metal such as iron, cobalt, nickel or alloys of these metals with metals such as aluminum, cobalt, copper, lead, magnesium, tin, zinc, antimony, beryllium, bismuth, cadmium, calcium, manganese, selenium, titanium, tungsten, vanadium, and mixtures thereof.

These ferromagnetic materials may have an average particle size of 0.1 to 1 microns, preferably about 0.1 to 0.5 microns. The amount contained in the toner may be about 40 to 200 parts by weight based on 100 parts by weight of the resin component, particularly preferably 50 to 150 parts by weight based on 100 parts by weight of the resin component, while this content should be determined depending on the relationship between the residual magnetization and particle size of the toner.

In the magnetic toner of the present invention, it is preferred that a charge controller may be incorporated in the toner particles (internal addition), or may be mixed with the toner particles (external addition). By using the charge controller, it is possible to most suitably control the charge amount corresponding to a developing system to be used.

Examples of the charge controller may include; nigrosine and its modification products modified by a fatty acid metal salt, quaternary ammonium salts, such as tributylbenzyl-ammonium-1 hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclo-hexyltin borate. These positive charge controllers may be used singly or as a mixture of two or more species. Among these, a nigrosine-type compound or a quaternary ammonium salt may particularly preferably be used.

As another type of positive charge controller, there may be used a homopolymer of a monomer having an amino group represented by the formula:

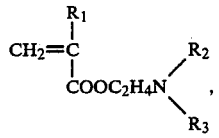

wherein $R_1$ represents H or $CH_3$; and $R_2$ and $R_3$ each represent a substituted or unsubstituted alkyl group (preferably $C_1$–$C_4$); or a copolymer of the monomer having an amine group with another polymerizable monomer such as styrene, acrylates, and methacrylates as described above. In this case, the positive charge controller also has a function of (a part or the entirety of) a binder.

On the other hand, a negative charge controller can be used in the present invention. Examples thereof may include an organic metal complex or a chelate compound. More specifically, there may preferably be used aluminum acetyl-acetonate, iron (II) acetylacetonate, an acetone-metal complex, and a 3,5-di-tertiary butylsalicylic acid-metal complex. There may more preferably be used acetylacetone complexes, or salicylic acid-type metal salts or complexes. Among these, salicylic acid-type complexes (inclusive of monoalkyl- or dialkyl-substituted derivative) or salicylic acid-type metal salts may particularly preferably be used.

In the case of internal addition, such charge controller may preferably be used in an amount of 0.1–20 wt. parts, more preferably 0.2–10 wt. parts, per 100 wt. parts of a binder resin.

It is preferred that silica fine powder is added to the magnetic toner of the present invention. The reason for this may be considered that the silica fine powder has an effect of appropriately leaking charges. When such silica fine powder is used, it is possible to retain a suitable amount of charges even under extremely low temperature-low humidity conditions, and to provide an excellent magnetic toner.

The silica fine powder may be those produced through the dry process and the wet process. The silica fine powder produced through the dry process is preferred in view of the anti-filming characteristic and durability thereof.

Among the above-mentioned silica powders, those having a specific surface area as measured by the BET method with nitrogen adsorption of 30 $m^2/g$ or more, particularly 50–400 $m^2/g$, provide a good result.

In the present invention, the silica fine powder may preferably be used in an amount of 0.01–8 wt. parts, more preferably 0.1–5 wt. parts, with respect to 100 wt. parts of the magnetic toner.

In the case where the magnetic toner of the present invention is used as a positively chargeable magnetic toner, it is preferred to use positively chargeable fine silica powder rather than negatively chargeable fine silica powder, in order to prevent the abrasion of the toner particle and the contamination on the sleeve surface, and to retain the stability in chargeability.

In order to obtain positively chargeable silica fine powder, the above-mentioned silica powder obtained through the dry or wet process may be treated with a silicone oil having an organic groups containing at least one nitrogen atom in its side chain, a nitrogen-containing silane coupling agent, or both of these.

In the present invention, "positively chargeable silica" means one having a positive triboelectric charge with respect to iron powder carrier when measured by the blow-off method.

The silicone oil having a nitrogen atom in its side chain to be used in the treatment of silica fine powder may be a silicone oil having at least the following partial structure:

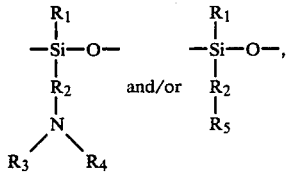

wherein $R_1$ denotes hydrogen, alkyl, aryl or alkoxyl; $R_2$ denotes alkylene or phenylene; $R_3$ and $R_4$ each denotes hydrogen, alkyl, or aryl; and $R_5$ denotes a nitrogen-containing heterocyclic group. The above alkyl, aryl, alkylene and phenylene group can contain an organic group having a nitrogen atom, or have a substituent such as halogen within an extent not impairing the chargeability.

The above-mentioned silicone oil may preferably be used in an amount of 1–50 wt. %, more preferably 5–30 wt. %, based on the weight of the silica fine powder.

The nitrogen-containing silane coupling agent used in the present invention generally has a structure represented by the following formula:

$$R_m-Si-Y_n,$$

wherein R is an alkoxy group or a halogen atom; Y is an organic group having at least one amino group or nitrogen atom; and m and n are positive integers of 1–3 satisfying the relationship of $m+n=4$.

Examples of the silane coupling agent include:
aminopropyltrimethoxysilane,
aminopropyltriethoxysilane,
dimethylaminopropyltrimethoxysilane,
diethylaminopropyltrimethoxysilane,
dipropylaminopropyltrimethoxysilane,
dibutylaminopropyltrimethoxysilane,
monobutylaminopropyltrimethoxysilane,
dioctylaminopropyltrimethoxysilane,
dibutylaminopropyldimethoxysilane,
dibutylaminopropylmonomethoxysilane,
dimethylaminophenyltriethoxysilane,
trimethoxysilyl-γ-propylphenylamine, and
trimethoxysilyl-γ-propylbenzylamine.
Further, examples of the compound containing a nitrogen-containing heterocyclic ring include:
trimethoxysilyl-γ-propylpiperidine,
trimethoxysilyl-γ-propylmorpholine, and
trimethoxysilyl-γ-propylimidazole.

The above-mentioned nitrogen-containing silane coupling agent may preferably be used in an amount of 1–50 wt. %, more preferably 5–30 wt. %, based on the weight of the silica fine powder.

The thus treated positively chargeable silica powder shows an effect when added in an amount of 0.01–8 wt. parts and more preferably may be used in an amount of 0.1–5 wt. parts, respectively with respect to the positively chargeable magnetic toner to show a positive chargeability with excellent stability. As a preferred mode of addition, the treated silica powder in an amount of 0.1–3 wt. parts with respect to 100 wt. parts of the positively chargeable magnetic toner should preferably be in the form of being attached to the surface of the toner particles. The above-mentioned untreated silica fine powder may be used in the same amount as mentioned above.

The silica fine powder used in the present invention may be treated as desired with another silane coupling agent or with an organic silicon compound for the purpose of enhancing hydrophobicity. The silica powder may be treated with such agents in a known manner so that they react with or are physically adsorbed by the silica powder. Examples of such treating agents include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

The above-mentioned treating agent may preferably be used in an amount of 1–40 wt. % based on the weight of the silica fine powder. However, the above treating agent may be used so that the final product of the treated silica fine powder shows positive chargeability.

In the present invention, it is preferred to add fine powder of a fluorine-containing polymer such as polytetrafluoroethylene, polyvinylidene fluoride, or tetrafluoroethylene-vinylidene fluoride copolymer. Among these, polyvinylidene fluoride fine powder is particularly preferred in view of fluidity and abrasiveness. Such powder of a fluorine-containing polymer may preferably be added to the toner in an amount of 0.01–2.0 wt.%, particularly 0.02–1.0 wt.%.

In a magnetic toner wherein the silica fine powder and the above-mentioned fluorine-containing fine powder are combined, while the reason is not necessarily clear, there occurs a phenomenon such that the state of the presence of the silica attached to the toner particle is stabilized and, for example, the attached silica is prevented from separating from the toner particle so that the effect thereof on toner abrasion and sleeve contamination is prevented from decreasing, and the stability in chargeability can further be enhanced.

An additive may be mixed in the magnetic toner of the present invention as desired. More specifically, as a colorant, known dyes or pigments may be used generally in an amount of 0.5–20 wt. parts per 100 wt. parts of a binder resin. Another optional additive may be added to the toner so that the toner will exhibit further better performances. Optional additives to be used include, for example, lubricants such as zinc stearate; abrasives such as cerium oxide and silicon carbide; flowability improvers such as colloidal silica and aluminum oxide; anticaking agent; or conductivity-imparting agents such as carbon black and tin oxide.

In the present invention, the absolute value of a charge amount Q/S (nc/cm$^2$) described hereinafter may preferably be 3–12 nc/cm$^2$, more preferably 4–11 nc/cm$^2$, particularly preferably 5–10 nc/cm$^2$.

Figure 2:
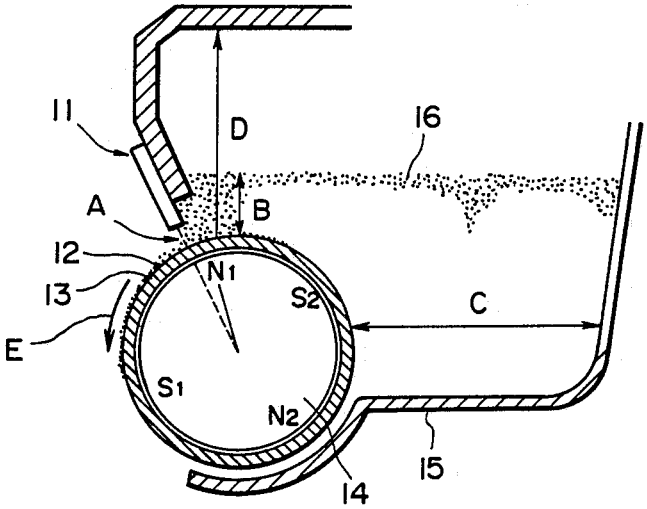
FIG. 2 is a schematic sectional view showing a device for measuring charge amount used in the present invention.

If Q/S>12 (nc/cm$^2$), the charging becomes excessive and the image force becomes too large, whereby blotched irregular coating is liable to occur even in an measurement device as shown in FIG. 2. When the residual magnetization of the toner is further increased in order to resist such charging, the ears of the toner become too long, whereby improvement in image quality cannot be achieved. When successive copying is conducted by using such toner, the toner particles are attached to a sleeve due to strong mirror image force, and it becomes difficult to cause them to fly to a photosensitive member, whereby a decrease in image density occurs. If Q/S<3 (nc/cm$^2$), the charge amount becomes insufficient thereby to lower the image density. Particularly, under an environment of high temperature and high humidity, the charge amount further decreases to provide a very low image density. In further successive copying, toner particles having a poor developing characteristic remain due to "selective development", thereby to cause a decrease in image density and a deterioration in image quality.

The magnetic toner for developing electrostatic images according to the present invention may be produced by sufficiently mixing magnetic powder with a vinyl or non-vinyl thermoplastic resin such as those enumerated hereinbefore, and optionally, a pigment or dye as colorant, a charge controller, etc., by means of a mixer such as a ball mill, etc.; then melting and kneading the mixture by hot kneading means such as hot rollers, kneader and extruder to disperse or dissolve the pigment or dye, in the melted resin; cooling and crushing the mixture; and subjecting the powder product to precise classification to form magnetic toner according to the present invention.

In the present invention inclusive of Examples and Comparative Examples appearing hereinafter, the amount of charges of magnetic toner particles disposed on a cylindrical sleeve is measured by using a measurement device as shown in FIG. 2 in the following manner.

A magnetic toner to be measured is charged in a measurement device wherein prescribed conditions are set as described hereinafter, and a cylindrical sleeve 12 is rotated at a peripheral speed of 150 mm/sec under conditions of 23° C. and 60 %RH to form a toner layer 13 on the sleeve 12. Thus, at prescribed time intervals, the charge amount per unit area of the toner layer 13 formed on the sleeve 12 is measured by using so-called "aspiration-type Faraday cylinder method".

In the aspiration-type Faraday cylinder method, an outer cylinder of the Faraday cylinder is pressed to the sleeve 12 to aspirate toner particles disposed on a prescribed area of the sleeve and to collect in the filter of an inner cylinder. From the resultant increase in the filter weight, there may be calculated the weight of the toner layer disposed on a unit area of the sleeve. Simultaneously with such measurement, a charge amount per unit area Q/S (nc/cm$^2$) of the sleeve may be determined by measuring the charge amount accumulated in the inner cylinder which is electrostatically shielded from the exterior.

Hereinbelow, there are described measurement conditions for the above-mentioned charge amount measurement device with reference to FIG. 2.

Referring to FIG. 2, the measurement device, which has been assembled similarly as developing apparatus, comprises a toner hopper 15, a cylindrical sleeve 12 disposed therein, and a magnetic blade 11 disposed opposite to the sleeve 12. In operation, the cylindrical sleeve 12 is rotated in the arrow E direction at a constant peripheral speed (150 mm/sec) by means of a driving motor (not shown), and a toner 16 contained in the toner hopper 15 is applied onto the cylindrical sleeve 12 through the medium of the magnetic blade 11 to form a thin layer 13 of the toner, and the charge amount is measured in the above-mentioned manner with the elapse of time. In FIG. 2, the gap or clearance between the blade 11 and the sleeve 12 is set to about 250 microns. With respect to the shape of the toner hopper 15, the distance from the sleeve 12 to the hopper wall is almost equal to the diameter of the sleeve 12, and the distance from the sleeve 12 to the roof wall of the hopper 15 is larger than the radius of the sleeve 12. The amount of the toner 16 charged in the toner hopper 15 is so set that the distance from the upper surface of the sleeve 12 to the surface of the toner 16 is larger than ½ of the sleeve radius and is smaller than the sleeve radius.

The cylindrical sleeve 12 contains a fixed magnet 14 disposed therein. The magnetic pole $N_1$ has a strength of about 800 G (Gauss) and is disposed about 5 degrees upstream (i.e., near to the hopper 15 side) of the position where the magnetic blade 11 is disposed opposite to the sleeve 12, with respect to the moving direction (arrow E) of the sleeve 12. The magnetic pole $S_1$, $N_2$ and $S_2$ have strengths of about 1000 G, about 750 G, about 550 G, respectively.

The sleeve 12 has a diameter of 20 mm and comprises stainless steel (SUS 304). The surface of the sleeve 12 has been subjected to blasting treatment by using glass beads comprising 80% by number or more of regular-shape glass bead particles with a diameter of 53–62 microns supplied from a blast nozzle, so that it has an unevenness comprising plural spherical trace concavities wherein a concavity diameter (R) is about 53–62 microns, an unevenness pitch (P) is about 33 microns, and a surface roughness (d) is about 2 microns. The pitch P and surface roughness d of the sleeve surface is determined by measuring the sleeve surface by means of a micro surface roughness tester (mfd. by Kosaka Kenkyusho K.K.).

Incidentally, in the present invention, the thin-line reproducibility may be measured in the following manner.

An original image comprising thin lines accurately having a width of 100 microns is copied under a suitable copying condition, i.e., a condition such that a circular original image having a diameter of 5 mm and an image density of 0.3 (halftone) is copied to provide a copy image having an image density of 0.3–0.5, thereby to obtain a copy image as a sample for measurement. An enlarged monitor image of the sample is formed by means of a particle analyzer (Luzex 450, mfd. by Nihon Regulator Co. Ltd.) as a measurement device, and the line width is measured by means of an indicator. Because the thin line image comprising toner particles has unevenness in the width direction, the measurement points for the line width are determined so that they correspond to the average line width, i.e., the average of the maximum and minimum line widths. Based on such measurement, the value (%) of the thin-line reproducibility is calculated according to the following formula:

$$\frac{\text{Line width of copy image obtained by the measurement}}{\text{Line width of the original (100 microns)}} \times 100$$

Further, in the present invention, the resolution may be measured in the following manner.

There is formed ten species of original images comprising a pattern of five thin lines which have equal line width and are disposed at equal intervals equal to the line width. In these ten species of original images, thin lines are respectively drawn so that they provide densities of 2.8, 3.2, 3.6, 4.0, 4.5, 5.0, 5.6, 6.3, 7.1, and 8.0 lines per 1 mm. These ten species of original images are copied under the above-mentioned suitable copying conditions to form copy images which are then observed by means of a magnifying glass. The value of the resolution is so determined that it corresponds to the maximum number of thin lines (lines/mm) of an image wherein all the thin lines are clearly separated from each other. As the above-mentioned number is larger, it indicates a higher resolution.

In the present invention (inclusive of Examples and Comparative Examples appearing hereinafter), the THF-insoluble is defined by the value measured as described below.

A toner sample is weighed in an amount of 0.5 to 1.0 g ($W_1$ g), placed in a cylindrical filter paper (e.g., No. 86R, produced by Toyo Roshi K.K.) and subjected to a Soxlet's extractor to effect extraction with the use of 100 to 200 ml of THF as the solvent for 6 hours. The soluble extracted with the solvent is subjected to evaporation, and then vacuum-dried at 100° C. for several hours, and the amount of the THF-solution resin component is weighed ($W_2$ g). The weight of the components other the resin component such as magnetic material or pigment in the toner is defined as ($W_3$ g). The THF-insoluble is defined from the following formula:

$$\text{THF-insoluble (\%)} = \frac{W1 - (W3 + W2)}{(W1 - W3)} \times 100$$

The particle distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1 %-NaCl aqueous solution as an electrolytic solution is prepared by using a reagent-grade sodium chloride. Into 100 to 150 ml of the electrolytic solution, 0.1 to 5 ml of a surfactant, (preferably an alkylbenzenesulfonic acid salt) is added as a dispersant, and 2 to 20 mg, of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. From the results of the volume-basis distribution and number-basis distribution, parameters characterizing the magnetic toner of the present invention may be obtained.

The melt index may be measured by using a device as described in Japanese Industrial Standards, JIS K 7210 (flow test for thermoplastic plastic) equipped with an orifice having an inside diameter of 2.0955±0.0051 mm and a length of 8.000±0.025 mm, under the conditions of a temperature of 125° C. and a load of 10 kg.

In the present invention (inclusive of Examples and Comparative Examples appearing hereinafter) the weight-average molecular weight Mw is defined by the value measured as described below, while it may be measured in various manners.

Through a column stabilized in a heat chamber at 40° C., THF (tetrahydrofuran) as the solvent is permitted to flow at a rate of 1.0 ml/min., and 300 μl of a THF sample solution of a resin controlled to a sample concentration of 0.1 wt. % is injected for measurement. In measuring the molecular weight of the sample, the molecular weight distribution possessed by the sample is calculated based on a calibration curve prepared from several kinds of mono-dispersed polystyrene standard samples. Preferred examples of the column may include, e.g., Shodex KF-80 M, KF 802, 803, 804 and 805 (mfd. by Showa Denko K.K.), while the column used in the present invention should not be restricted to these specific examples. In order to accurately effect measurement, it is preferred to use a combination of two or more species of these columns.

In the present invention, the magnetic characteristics of the magnetic toner are based on the values which have been measured by means of a measurement device VSM P-1-10 (mfd. by Toei Kogyo K.K.) at room temperature under an external magnetic field of 1 KÖe.

Hereinbelow, the present invention will be described in further detail with reference to Examples. In the following formulations, "parts" are parts by weight.

Example 1

| | |
|---|---|
| Styrene/2-ethylhexyl acrylate/divinyl benzene copolymer*1 (copolymerization wt. ratio: 78/18.5/3.5, weight-average molecular weight (Mw): 140,000, THF-insoluble: 80 wt. %) | 60 wt. parts |
| Styrene/butyl acrylate copolymer*2 (copolymerization wt. ratio: 82/18, THF-insoluble: 0 wt. %, Mw = 280,000) | 40 wt. parts |
| Magnetic powder (an excess iron component-type ferrite powder, average particle size: 0.25 micron, $\sigma_r$ = 12.5 emu/g) | 85 wt. parts |
| Nigrosine | 3 wt. parts |
| Low-molecular weight propylene-butene copolymer (Mw = 5,500) | 5 wt. parts |

*1: The content of a component having a molecular weight of 2,000–10,000 in the THF-soluble was 40 wt. %.
*2: The content of a component having a molecular weight of 2,000–10,000 in the THF-soluble was 18 wt. %.

(The binder resin comprising the above-mentioned two species of styrene-type copolymers is contained in 48 wt. parts of THF-soluble per 100 wt. parts thereof.)

The above ingredients were sufficiently mixed by means of a Henschel mixer and melt-kneaded by means of a kneading mixer set to 180° C.

The kneaded product was cooled, coarsely crushed by a cutter mill, finely pulverized by means of a micro pulverizer using jet air stream (I-type Jet Mill, mfd. by Nippon Pneumatic Mfd. Co., Ltd.), and classified by a fixed-wall type wind-force classifier (DS-type Wind-Force Classifier, mfd. by Nippon Pneumatic Mfd. Co. Ltd.) to obtain a dry insulating magnetic toner.

The thus obtained magnetic toner had a volume-average particle size of 8.5 microns, a residual magnetization of 3.2 emu/g, and a melt index of 3.1 g/10 min. The low-molecular propylene-butene copolymer was contained in an amount of 2.6 wt. % based on the magnetic toner (i.e., 4.9 wt. % based on the binder resin).

0.6 wt. parts of positively chargeable hydrophobic silica (BET specific surface area: 130 $m^2/g$) was added to 100 wt. parts of the magnetic toner obtained above and mixed therewith by means of a Henschel mixer thereby to obtain a one-component type developer (i.e., a toner containing externally added silica).

The maximum value of Q/S measured in the above-mentioned manner was 9.5 $nc/m^2$, and during the measurement for 2 hours, there was no trouble on the developing sleeve and a uniform toner coating layer was constantly retained. In the developing zone, the magnetic toner particles formed ears having a height of about 90 microns.

The above-prepared one-component developer was applied to a copying machine (NP 3525, mfd. by Canon K.K.) which had been modified by removing an oil application device from the fixing device so that it could easily cause offset phenomenon, and subjected an image formation test of 10,000 sheets.

There are described driving conditions for the above-mentioned test machine with reference to FIG. 1. The gap between a sleeve 3 and a blade 2 was 250 microns, the magnetic field in the neighborhood of the sleeve 3 surface exerted by a fixed magnet 5 was 1,000 gauss, the minimum distance between a photosensitive drum 4 and the sleeve 3 was about 300 microns, and the bias voltage was a superposition of a DC voltage and an AC voltage (2,000 Hz/1350 Vpp). The results are shown in Table 1 appearing hereinafter.

As apparent from Table 1, the image density was high, and the magnetic toner of the present invention was excellent in thin-line reproducibility and resolution, and retained good image quality obtained in the initial stage even after 10,000 sheets of image formations. Further, blocked irregular coating did not occur in the image formation, and there was no trouble with respect to fixing and offset phenomenon.

Example 2

| | |
|---|---|
| Styrene/butyl acrylate/ethylene glycol diacrylate copolymer*3 (copolymerization wt. ratio: 83/16.5/0.5, weight-average molecular weight (Mw): 350,000, THF-insoluble: 9 wt. %) | 100 wt. parts |
| Magnetic powder | 120 wt. parts |
| Nigrosine | 2 wt. parts |
| Low-molecular weight polypropylene (Mw = 15,000) | 4 wt. parts |

*3: The content of a component having a molecular weight of 2,000–10,000 in the THF-soluble was 20 wt. %.

By using the above ingredients, a magnetic toner was prepared in the same manner as in Example 1.

The thus obtained magnetic toner had a volume-average particle size of 4.1 microns, a residual magnetization of 5.2 emu/g, and a melt index of 12 g/10 min.

0.8 wt. parts of hydrophobic silica was added to 100 wt. parts of the magnetic toner obtained above and mixed therewith by means of a Henschel mixer thereby to obtain a one-component type developer (i.e., a toner containing externally added silica). The silica used herein was positively chargeable hydrophobic silica, and was one obtained by treating 100 wt. parts of dry process silica fine powder (trade name: Aerosil #130, specific surface area: about 130 $m^2/g$, mfd. by Nihon Aerosil K.K.) with a silicone oil having an amine in its side chain (viscosity at 25° C.: 70 cps, amine equivalent: 830) under stirring at about 250° C.

The maximum value of Q/S measured in the above-mentioned manner was 90 $nc/m^2$, and during the measurement for 2 hours, there was no trouble on the developing sleeve and a uniform toner coating layer was constantly retained. In the developing zone, the magnetic toner particles formed ears having a height of about 60 microns.

The above-prepared one-component developer was evaluated in the same manner as in Example 1, clear high-quality images were stably obtained as shown in Table 1.

Example 3

| | |
|---|---|
| Styrene/butyl acrylate/divinyl benzene copolymer*5 (copolymerization wt. ratio: 78/19.5/2.5, weight-average molecular weight (Mw): 210,000, THF-insoluble: 59 wt. %) | 100 wt. parts |
| Magnetic powder | 65 wt. parts |
| Nigrosine | 2 wt. parts |
| Low-molecular weight propylene-ethylene copolymer (Mw = 8,500) | 4 wt. parts |

*5: The content of a component having a molecular weight of 2,000–10,000 in the THF-soluble was 34 wt. %.

By using the above ingredients, a magnetic toner was prepared in the same manner as in Example 1.

The thus obtained magnetic toner had a volume-average particle size of about 15 microns, a residual magnetization of 2.4 emu/g, and a melt index of 0.45 g/10 min.

0.3 wt. parts of positively chargeable hydrophobic silica was added to 100 wt. parts of the magnetic toner obtained above and mixed therewith by means of a Henschel mixer thereby to obtain a one component type developer (i.e., a toner containing externally added silica).

The maximum value of Q/S measured in the above-mentioned manner was 6.5 $nc/m^2$, and during the measurement for 2 hours, there was no trouble on the developing sleeve and a uniform toner coating layer was constantly retained. In the developing zone, the magnetic toner particles formed ears having a height of about 140 microns.

The above-prepared one-component developer was evaluated in the same manner as in Example 1, clear high-quality images were stably obtained as shown in Table 1.

Example 4

| | |
|---|---|
| Styrene/2-ethylhexyl acrylate/divinyl | 60 wt. parts |

-continued

| | |
|---|---|
| benzene copolymer (the same as in Example 1) | |
| Styrene/butyl acrylate copolymer (the same as in Example 1) | 40 wt. parts |
| Triiron tetroxide (average particle size: 0.15 micron,) | 90 wt. parts |
| 3,5-di-tert-butylsalicyclic acid metal salt | 1 wt. part |
| Low-molecular weight propylene-ethylene copolymer (Mw = 23,000) | 3 wt. parts |

By using the above ingredients, a magnetic toner of fine black powder was prepared in the same manner as in Example 1.

0.4 wt. part of negatively chargeable hydrophobic silica powder (BET specific surface area: 130 $m^2/g$) was added to 100 wt. parts of the magnetic toner obtained above and mixed therewith by means of a Henschel mixer thereby to obtain a negatively chargeable one-component type developer (i.e., a toner containing externally added silica).

The thus obtained developer had a volume-average particle size of 4.5 microns, a residual magnetization of 3.5 emu/g, and a melt index of 3.3 g/10 min.

The maximum value of Q/S measured in the above-mentioned manner was $-8.5$ nc/$m^2$, and during the measurement, there was no blotched irregular coating on the developing sleeve.

The above-prepared one-component developer was applied to a copying machine having an amorphous silicone photosensitive drum capable of forming a positively charged electrostatic latent image (NP 7550, mfd. by Canon K.K.) which had been modified by removing an oil application device, and subjected an image formation test of 10,000 sheets. As a result, clear high-quality images were stably obtained as shown in Table 1.

Example 5

The positively chargeable one-component developer prepared in Example 1 was applied to a digital-type copying machine having an amorphous silicone photosensitive drum (NP 9330, mfd. by Canon K.K.), and subjected an image formation test of 10,000 sheets. As a result, as shown in Table 1, the thin-line reproducibility and the resolution were constantly excellent and there were obtained clear images excellent in a gradational characteristic.

As described hereinabove, according to the present invention, the following effects are obtained.

(1) There is provided a magnetic toner capable of providing an image having high image density excellent in thin-line reproducibility and gradational characteristic.

(2) There is provided a magnetic toner which shows little change in performances and image quality when used in a long period or environmental conditions change.

(3) There is provided a magnetic toner which does not impair image quality in a fixing step.

(4) There is provided a magnetic toner which is capable of providing a high image density by using a small consumption thereof.

(5) There is provided a magnetic toner capable of providing good performances even when used in image formation using a digital image signal.

Comparative Example 1

| | |
|---|---|
| Styrene/butyl acrylate copolymer (copolymerization wt. ratio: 83/17, weight-average molecular weight (Mw): 270,000, THF-insoluble: 0 wt. %) | 100 wt. parts |
| Triiron tetroxide ($\sigma_r$ = 10.5 emu/g) | 50 wt. parts |
| Nigrosine | 3 wt. parts |
| Low-molecular weight polypropylene | 5 wt. parts |

By using the above ingredients, a magnetic toner was prepared in the same manner as in Example 1.

The thus obtained magnetic toner had a volume-average particle size of 12 microns, a residual magnetization of 1.7 emu/g, and a melt index of 15 g/10 min.

0.4 wt. part of hydrophobic silica was added to 100 wt. parts of the magnetic toner obtained above and mixed therewith by means of a Henschel mixer thereby to obtain a one-component type magnetic developer.

The maximum value of Q/S measured in the above-mentioned manner was 14.5 nc/$m^2$. In the measurement, blotched irregular coating began to occur after 2 min. counted from the measurement initiation. The thus obtained developer was subjected to image formation and evaluated in the same manner as in Example 1.

As a result, the ears formed on the sleeve had a height of about 110 micron but had a disturbed shape wherein tower-like ears overlapped with each other. Further, the thin-line reproducibility and the resolution was poor and there was observed a decrease in image density, and deterioration in thin-line reproducibility and resolution, when the image formation was successively conducted.

Comparative Example 2

| | |
|---|---|
| Styrene/n-butyl acrylate copolymer (same binder resin as that used in Example 2) | 100 wt. parts |
| Triiron tetroxide ($\sigma_r$ = 5.8 emu/g) | 80 wt. parts |
| Nigrosine | 2 wt. parts |
| Low-molecular weight polypropylene | 4 wt. parts |

By using the above ingredients, a magnetic toner was prepared in the same manner as in Example 1.

The thus obtained magnetic toner had a volume-average particle size of 7.5 microns, a residual magnetization of 1.5 emu/g which was smaller than the range defined by the present invention, and a melt index of 3.0 g/10 min.

By using the thus obtained toner, a developer was prepared in the same manner as in Example 1. The thus obtained developer was subjected to image formation and evaluated in the same manner as in Example 1. As a result, there were obtained relatively good images in an initial stage, but there were provided images which showed coarsening in image quality and a decrease in image density and were lacking in sharpness.

When the toner was applied onto a rotating sleeve without development in the manner as defined by the present invention, it was observed that the Q/S was as high as 10.0, and blotched irregular coating after 10 min. We believe that such trouble was caused by too small $\sigma_r$ of the toner with respect to the particle size.

Comparative Example 3

A magnetic toner was prepared in the same manner as in Example 1 except that the amount of the magnetic material was changed to 110 parts, and the resultant magnetic toner was evaluated in the same manner as in Example 1.

The thus obtained magnetic toner had a volume-average particle size of 9.5 microns, a residual magnetization of 4.8 emu/g which was larger than the range defined by the present invention, and a melt index of 3.5 g/10 min.

By using the thus obtained toner, a developer was prepared in the same manner as in Example 1. The thus obtained developer was evaluated in the same manner as in Example 1.

As a result, the ears of the magnetic toner were as high as about 170 microns, and there were obtained images having poor in thin-line reproducibility and resolution wherein protrusion of toner particles from minute latent images and scattering were remarkable. Further, there occurred fog due to uneven charging, and a decrease in image density and deterioration in image quality due to successive image formation. The maximum value of Q/S measured in the above-mentioned manner defined by the present invention as 5.0 nc/cm$^2$.

The results obtained in the above Examples and Comparative Examples are inclusively shown in the following Table.

TABLE 1A

| | Initial stage | | | After 10,000 sheets of image formation | | |
|---|---|---|---|---|---|---|
| | Dmax. | Thin-line reproducibility | Resolution | Dmax | Thin-line reproducibility | Resolution |
| Example 1 | 1.38 | 104% | 6.3 line/mm | 1.40 | 104% | 6.3 lines/mm |
| 2 | 1.39 | 101 | 7.1 | 1.40 | 101 | 7.1 |
| 3 | 1.32 | 110 | 5.6 | 1.35 | 115 | 5.6 |
| 4 | 1.35 | 103 | 6.3 | 1.36 | 105 | 7.1 |
| 5 | 1.39 | 102 | 7.1 | 1.41 | 100 | 7.1 |
| Comp. 1 | 1.30 | 140 | 4.5 | 1.14 | 170 | 4.0 |
| Example 2 | 1.37 | 105 | 6.3 | 1.30 | 115 | 5.6 |
| 3 | 1.25 | 125 | 4.5 | 1.20 | 140 | 4.0 |

TABLE 1B

| | Results of measurement using charge amount measurement device | | | |
|---|---|---|---|---|
| | \|Q/S\| nc/cm$^2$ | Ear height (μm) | Ear shape | State of coating on sleeve |
| Example 1 | 8.0 | 90 | Good*1 | Good*3 |
| 2 | 9.0 | 60 | Good*1 | Good*3 |
| 3 | 6.5 | 140 | Good*1 | Good*3 |
| 4 | 8.5 | 50 | Good*1 | Good*3 |
| 5 | | | | |
| Comp. 1 | 14.5 | 110 | Poor*2 | Blotch occurred |
| Example 2 | 11.0 | 90 | Poor*2 | Blotch occurred |
| 3 | 5.0 | 170 | Poor*2 | Coating was coarse |

*1Each ear was linear and disposed separately from another ear.
*2Each ear had a tower-like shape.
*3Toner coating was uniform.

We claim:

1. A magnetic toner, comprising a binder resin, magnetic powder and 0.1–10 wt. % based on the resin component of a low-molecular weight polyalkylene, said binder resin comprising a vinyl-type polymer having 5 to 80 wt. % of a tetrahydrofuran-insoluble; said magnetic toner having a melt index of 0.2 to 12 g/10 min. at 125° C., and 10 kg load; the residual magnetization $\sigma_r$ and the volume-average particle size d of said magnetic toner satisfying the following formula:

$$3.7-0.11d \leqq \sigma_r \leqq 6.5-0.23d,$$

wherein $\sigma_r$ represents a residual magnetization in emu/g under an external magnetic field of 1 KÖe and d represents a volume-average particle size of 3 to 16 microns; wherein the magnetic powder has an average particle size of 0.1 –1 micron and is contained in an amount of 40–200 wt. parts per 100 wt. parts of resin component.

2. A magnetic toner according to claim 1, wherein the binder resin comprises a vinyl-type copolymer.

3. A magnetic toner according to claim 2, wherein the binder resin comprises a crosslinked vinyl-type copolymer.

4. A magnetic toner according to claim 3, wherein the binder resin comprises a crosslinked styrene-acrylic acid ester type copolymer or a styrene-methacrylic acid ester type copolymer.

5. A magnetic toner according to claim 1, wherein the binder resin contains 10–60 wt. % of a THF-insoluble.

6. A magnetic toner according to claim 1, which has a melt index value of 0.5 to 8 g/10 min.

7. A magnetic toner according to claim 1, wherein the low-molecular weight polyalkylene has a weight-average molecular weight of 2,000–30,000.

8. A magnetic toner according to claim 1, wherein the low-molecular weight polyalkylene is contained in an amount of 0.5 to 8 wt. % based on resin component.

9. A magnetic toner according to claim 1, wherein the magnetic powder has an average particle size of 0.1–0.5 micron.

10. A magnetic toner according to claim 8, wherein the magnetic powder is contained in an amount of 50–150 wt. parts per 100 wt. parts of resin component.

11. A magnetic toner according to claim 1, wherein the binder resin contains a charge controller.

12. A magnetic toner according to claim 1, which has been mixed with silica fine powder.

13. A magnetic toner according to claim 1, which has a triboelectric chargeability so as to provide an absolute value of charge amount Q/S expressed as nc/cm$^2$ of 3 to 12 nc/cm$^2$.

14. A magnetic toner according to claim 13, which has a triboelectric chargeability so as to provide an absolute value of charge amount Q/S expressed as nc/cm$^2$ of 4 to 11 nc/cm$^2$.

15. A magnetic toner according to claim 14, which has a triboelectric chargeability so as to provide an absolute value of charge amount Q/S expressed as nc/cm$^2$ of 5 to 10 nc/cm$^2$.

16. A magnetic toner according to claim 1, which contains a positive charge controller and has been mixed with positively chargeable hydrophobic silica fine powder.

17. A magnetic toner according to claim 16, wherein the charge controller comprises Nigrosine, and the silica fine powder comprises silica fine powder treated with an amino-modified silicone oil.

18. A magnetic toner according to claim 1, which contains a negative charge controller and has been mixed with negative hydrophobic silica fine powder.

19. A magnetic toner according to claim 18, wherein the magnetic charge controller comprises an organic metal complex.

20. In the process for developing electrophotographic images with a one-component magnetic toner by the steps of:

(a) forming an electrostatic latent image on a photosensitive member, and (b) developing said latent image with said one-component magnetic toner, the improvement which comprises employing the magnetic toner of claim 1 as the one-component magnetic toner.

* * * * *

UNITED STATES PATENT AND TRADEMARK OFFICE

CERTIFICATE OF CORRECTION

PATENT NO. : 4,952,476

DATED : August 28, 1990

INVENTOR(S) : KIICHIRO SAKASHITA, ET AL.

It is certified that error appears in the above-identified patent and that said Letters Patent is hereby corrected as shown below:

COLUMN 14

Line 23, "clearance" should read --clearance A--.
Line 26, "distance" should read --distance C--.
Line 28, "distance should read --distance D--.
Line 31, "distance" should read --distance B--.

COLUMN 15

Line 46, "other" should read --other than--.

COLUMN 17

Line 6, "mfd." should read --mfg.--.
Line 7, "Mfd." should read --Mfg.--.
Line 9, "mfd." should read --mfg.-- and
"Mfd." should read --Mfg.--.

UNITED STATES PATENT AND TRADEMARK OFFICE

CERTIFICATE OF CORRECTION

PATENT NO. : 4,952,476

DATED : August 28, 1990

INVENTOR(S) : KIICHIRO SAKASHITA, ET AL.

It is certified that error appears in the above-identified patent and that said Letters Patent is hereby corrected as shown below:

COLUMN 19

Line 5, "micron,)" should read --micron)--.

Signed and Sealed this

Tenth Day of September, 1996

Bruce Lehman

*Attest:*

BRUCE LEHMAN

*Attesting Officer*

*Commissioner of Patents and Trademarks*